US010179267B1

(12) United States Patent
Walker, Jr.

(10) Patent No.: US 10,179,267 B1
(45) Date of Patent: Jan. 15, 2019

(54) GAME SYSTEM

(71) Applicant: Wilmer David Walker, Jr., Atlanta, GA (US)

(72) Inventor: Wilmer David Walker, Jr., Atlanta, GA (US)

( * ) Notice: Subject to any disclaimer, the term of this patent is extended or adjusted under 35 U.S.C. 154(b) by 0 days.

(21) Appl. No.: 15/925,530

(22) Filed: Mar. 19, 2018

(51) Int. Cl.
*A63B 47/00* (2006.01)
*A63B 69/00* (2006.01)

(52) U.S. Cl.
CPC ..... *A63B 47/001* (2013.01); *A63B 69/0086* (2013.01); *A63B 2208/0204* (2013.01)

(58) Field of Classification Search
CPC ..... A63B 47/001; A63B 69/0086
USPC ..... 473/507; 273/317, 329–331, 348, 273/333–335
See application file for complete search history.

(56) References Cited

U.S. PATENT DOCUMENTS

| | | | | |
|---|---|---|---|---|
| 1,947,859 | A | 2/1934 | Lathers | |
| 2,089,652 | A | 8/1937 | Kelly | |
| 2,480,264 | A | 8/1949 | Regenold | |
| 2,488,919 | A | 11/1949 | Mansfield | |
| 2,570,860 | A | 10/1951 | Redding | |
| 2,670,204 | A | 2/1954 | Powell | |
| 3,078,099 | A | 2/1963 | Hyman | |
| 3,610,622 | A | 10/1971 | Haroski | |
| D226,770 | S | 4/1973 | Prischak | |
| 3,774,910 | A | 11/1973 | Walker, Jr. | |
| 3,782,727 | A | 1/1974 | Chirnomas | |
| 3,836,143 | A | 9/1974 | Trent | |
| 3,936,051 | A | 2/1976 | Walker, Jr. | |
| D239,648 | S | 4/1976 | Somsky | |
| 4,000,898 | A | 1/1977 | Cooter | |
| 4,013,292 | A | 3/1977 | Cohen et al. | |
| 4,059,271 | A | 11/1977 | Dupre | |
| D248,585 | S | 7/1978 | Lincoln | |
| 4,236,714 | A | 12/1980 | Locke | |
| 4,248,435 | A | 2/1981 | Barmore | |
| 4,274,639 | A | 6/1981 | Flanders | |
| 4,311,310 | A | 1/1982 | Dankman et al. | |
| 4,673,182 | A | 6/1987 | Bowen | |
| 4,674,987 | A | 6/1987 | Sober | |
| 4,744,563 | A | 5/1988 | Anastasia et al. | |
| 4,911,432 | A | 3/1990 | Walden | |
| 5,163,680 | A | 11/1992 | Amron | |
| 5,244,206 | A | 9/1993 | Clark | |
| 5,249,810 | A | 10/1993 | Cazalet | |
| 5,286,031 | A | 2/1994 | Walker, Jr. | |
| 5,338,026 | A * | 8/1994 | Kregel | A63B 69/0079 473/139 |
| 5,348,307 | A | 9/1994 | Duggan | |

(Continued)

FOREIGN PATENT DOCUMENTS

| | | | |
|---|---|---|---|
| WO | WO2004112919 | A1 | 12/2004 |
| WO | WO2011063393 | A1 | 5/2011 |

*Primary Examiner* — Melba Bumgarner
*Assistant Examiner* — Rayshun Peng
(74) *Attorney, Agent, or Firm* — Thomas B. McGurk

(57) ABSTRACT

A game system is disclosed that can be played using gross motor skills. The game system is mountable on the player's torso and comprises a tethered ball that can be kicked by the player into a goal mounted on the neck of the base of the game system. The game system can include a fastener for detachably connecting different balls to the game system.

11 Claims, 10 Drawing Sheets

(56) References Cited

U.S. PATENT DOCUMENTS

| | | | | | |
|---|---|---|---|---|---|
| 5,368,306 | A * | 11/1994 | Madsen | A63B 67/083 | |
| | | | | 473/510 | |
| 5,377,996 | A | 1/1995 | Shure | | |
| 5,405,149 | A | 4/1995 | Allen | | |
| D365,128 | S | 12/1995 | Testasecca et al. | | |
| 5,611,540 | A * | 3/1997 | Williams | A63B 43/007 | |
| | | | | 473/429 | |
| 5,722,662 | A | 3/1998 | Howell | | |
| 6,220,917 | B1 | 3/2001 | Nelson | | |
| 6,910,977 | B2 | 6/2005 | Baquero | | |
| 6,991,509 | B1 | 1/2006 | Carley et al. | | |
| 7,641,199 | B1 | 1/2010 | Clarke | | |
| 7,909,329 | B1 | 3/2011 | Martinson | | |
| 8,366,571 | B2 | 2/2013 | Walker, Jr. | | |
| D685,857 | S | 7/2013 | Walker, Jr. | | |
| 8,500,576 | B2 | 8/2013 | Walker, Jr. | | |
| 9,630,088 | B2 | 4/2017 | Walker, Jr. | | |
| 2004/0036211 | A1 | 2/2004 | Oister et al. | | |
| 2006/0175750 | A1 | 8/2006 | Ware | | |
| 2011/0121512 | A1* | 5/2011 | Walker, Jr. | A63B 67/10 | |
| | | | | 273/333 | |

* cited by examiner

GAME SYSTEM

TECHNOLOGICAL FIELD

The present disclosure relates to games and entertainment devices and, more particularly, to game systems employing gross motor skills.

BACKGROUND

Games and entertainment devices today are often geared to relatively passive play, requiring only fine motor skills, wherein the user's hands alone direct the course of play. Such games and entertainment devices allow for game play to occur without the player engaging in much body movement, thereby further contributing to maintenance of a sedentary level of activity even when an individual is engaged in play. The design of such games also tends to favor those players whose fine motor skills have fully developed and not yet waned. Thus, when a group that includes individuals of varying levels of fine motor skills, such as a family, is selecting a game to play as a group, such games tend to make for poor choices as they hinder effective competition by those whose fine motor skills are not comparable to others with optimal fine motor skills. Accordingly, there is a need for a game system that potentially can address one or more of the shortcomings of the typical game.

SUMMARY

The present disclosure encompasses a game system configured to be secured to a player's body and to provide a goal and a ball that can be kicked by the player into the goal. The present disclosure encompasses game system for playing a goal-scoring game using the player's feet, knees, or other parts of the legs to kick a ball, the game system comprising a base, wherein the base comprises a baseboard and a neck extending from the baseboard, whereby the baseboard is configured to be aligned against a player's torso; a strap connected to the base, whereby the strap is configured to engage a portion of the player's torso to align the baseboard of the base against the player's torso; a goal mounted on the neck of the base, wherein the goal comprises a basket with a goal rim thereon, wherein the goal rim defines a goal opening; a ball; a tether suspended from an anchor site disposed below the goal, wherein the tether comprises an elongated rigid tether member and a flexible tether member, wherein the elongated rigid tether member comprises a proximal end and a distal end, wherein the elongated rigid tether member is pivotally mounted below the goal with the proximal end of the elongated rigid tether member aligned proximal to the anchor site and the distal end of the elongated rigid tether member aligned distal to the anchor site, wherein the flexible tether member is connected to the distal end of the elongated tether member, wherein the ball is connected to the flexible tether member, and wherein the ball is configured to be kicked by the player; and, a blocker plate mounted on the neck of the base and disposed below the goal, wherein the blocker plate comprises a plurality of blocker lobes and a plurality of channels, wherein each channel of the plurality of channels is disposed between two blocker lobes of the plurality of blocker lobes, wherein each blocker lobe of the plurality of blocker lobes is aligned to arrest upward movement of the elongated rigid tether member and to block the distal end of the elongated rigid tether member from moving above the blocker plate, wherein each channel of the plurality of channels is aligned to allow movement of the distal end of the elongated rigid tether member above the blocker plate, wherein each channel of the plurality of channels comprises a first side, a second side opposing the first side, a distal channel end aligned distal to the goal, and a proximal channel end aligned proximal to the goal, wherein the distal channel end is wider than the proximal channel end, and wherein the first side of each channel of the plurality of channels is aligned nonparallel to the second side of each channel. In another aspect, the anchor site is aligned on an axis extending through a center of the goal opening. In a further aspect, each channel of the plurality of channels comprises a midline, and wherein the midline of each channel of the plurality of channels is radially aligned with the axis. In still another aspect, each blocker lobe of the plurality of blocker lobes comprises an arcuate outer edge. In yet a further aspect, the tether further comprises a fastener, and wherein the flexible tether member is detachably connected to the elongated rigid tether member by the fastener. In another aspect, the fastener comprises a first fastener component mounted on the elongated rigid tether member and a second fastener component mounted on the flexible tether member, and wherein the first fastener component and the second fastener component cooperate to detachably connect the elongated rigid tether member to the flexible tether member.

The present disclosure also encompasses a game system for playing a goal scoring game using the player's feet to kick a ball, the game system comprising a base, wherein the base comprises a baseboard and a neck extending from the baseboard, whereby the baseboard is configured to be aligned against a player's torso; a strap connected to the base, whereby the strap is configured to engage a portion of the player's torso to align the baseboard of the base against a player's torso; a goal mounted on the neck of the base, wherein the goal comprises a goal rim, wherein the goal rim defines a goal opening; a ball; a tether suspended below the goal rim, wherein the tether comprises a first flexible member connected to a proximal end of an elongated rigid tether member and a second flexible tether member connected to a distal end of the elongated rigid tether member, and a fastener detachably connecting the elongated rigid tether member to the second flexible tether member, wherein the fastener comprises a first fastener component and a second fastener component, wherein the first fastener component is connected to the distal end of the elongated rigid tether member and the second fastener component is connected to the second flexible tether member, wherein the elongated rigid tether member is pivotally mounted below the goal rim with the proximal end of the elongated rigid tether member aligned proximal to the goal and the distal end of the elongated rigid tether member aligned distal to goal, wherein the second flexible tether member is connected to the distal end of the elongated tether member, wherein the ball is connected to the second flexible tether member, and wherein the ball is configured to be kicked by the player; and, a blocker plate mounted on the neck of the base and disposed below the goal rim, wherein the blocker plate comprises a plurality of blocker lobes and a plurality of channels, wherein each channel of the plurality of channels is disposed between two blocker lobes of the plurality of blocker lobes, wherein each blocker lobe of the plurality of blocker lobes is aligned to arrest upward movement of the elongated rigid tether member and to block the distal end of the elongated rigid tether member from moving above the blocker plate, and wherein each channel of the plurality of channels is aligned to allow movement of the distal end of the elongated rigid tether member above the blocker plate.

In another aspect, the first fastener component comprises a first thread and the second fastener member comprises a second thread, and wherein the first thread and the second thread cooperate to detachably connect the second flexible tether member to the elongated rigid tether member. In yet another aspect, the goal comprises a basket disposed above the blocker plate. In a further aspect, the first flexible member of the tether is suspended from an anchor site below the goal rim, and wherein the anchor site is disposed on an axis extending through the goal rim. In still another aspect, each channel of the plurality of channels comprises a midline, and wherein the midline of each channel of the plurality of channels is radially aligned with the axis. In another aspect, each blocker lobe of the plurality of blocker lobes comprises an arcuate outer edge. In yet another aspect, each channel of the plurality of channels comprises a first side, a second side opposing the first side, a distal channel end aligned distal to the goal, and a proximal channel end aligned proximal to the goal, wherein the distal channel end is wider than the proximal channel end, and wherein the first side of each channel of the plurality of channels is aligned nonparallel to the second side of each channel.

The present disclosure also encompasses a game system for playing a goal scoring game using the player's feet to kick a ball, the game system comprising a base, wherein the base comprises a baseboard and a neck extending from the baseboard, whereby the baseboard is configured to be aligned against a player's torso; a strap connected to the base, whereby the strap is configured to engage a portion of the player's torso to align the baseboard of the base against a player's torso; a ball; a goal mounted on the neck of the base, wherein the goal comprises basket comprising a goal rim thereon; a tether mounted at anchor site disposed below the basket, wherein the tether comprises a first flexible member connected to a proximal end of an elongated rigid tether member and a second flexible tether member connected to a distal end of the elongated rigid tether member, and a fastener detachably connecting the elongated rigid tether member to the second flexible tether member, wherein the fastener comprises a first fastener component and a second fastener component, wherein the first fastener component is attached to the distal end of the elongated rigid tether member and the second fastener component is attached to the second flexible tether member, wherein the elongated rigid tether member is pivotally mounted below the goal rim with the proximal end of the elongated rigid tether member aligned proximal to the goal and the distal end of the elongated rigid tether member aligned distal to goal, wherein the second flexible tether member is connected to the distal end of the elongated tether member, wherein the ball is connected to the second flexible tether member, and wherein the ball is configured to be kicked by the player; and, a blocker plate mounted on the base and disposed below the basket, wherein the blocker plate comprises a plurality of blocker lobes and a plurality of channels, wherein each channel of the plurality of channels is disposed between two blocker lobes of the plurality of blocker lobes, wherein each channel comprises a distal channel end and a proximal channel end, wherein the distal channel end is wider than the proximal channel end, wherein each blocker lobe comprises an arcuate outer edge, wherein each blocker lobe of the plurality of blocker lobes is aligned to arrest upward movement of the elongated rigid tether member and to block the distal end of the elongated rigid tether member from moving above the blocker plate, and wherein each channel of the plurality of channels is aligned to allow movement of the distal end of the elongated rigid tether member above the blocker plate.

These and other aspects of the present disclosure are set forth in greater detail below and in the drawings for which a brief description is provided as follows.

DETAILED DESCRIPTION

Figure 1:
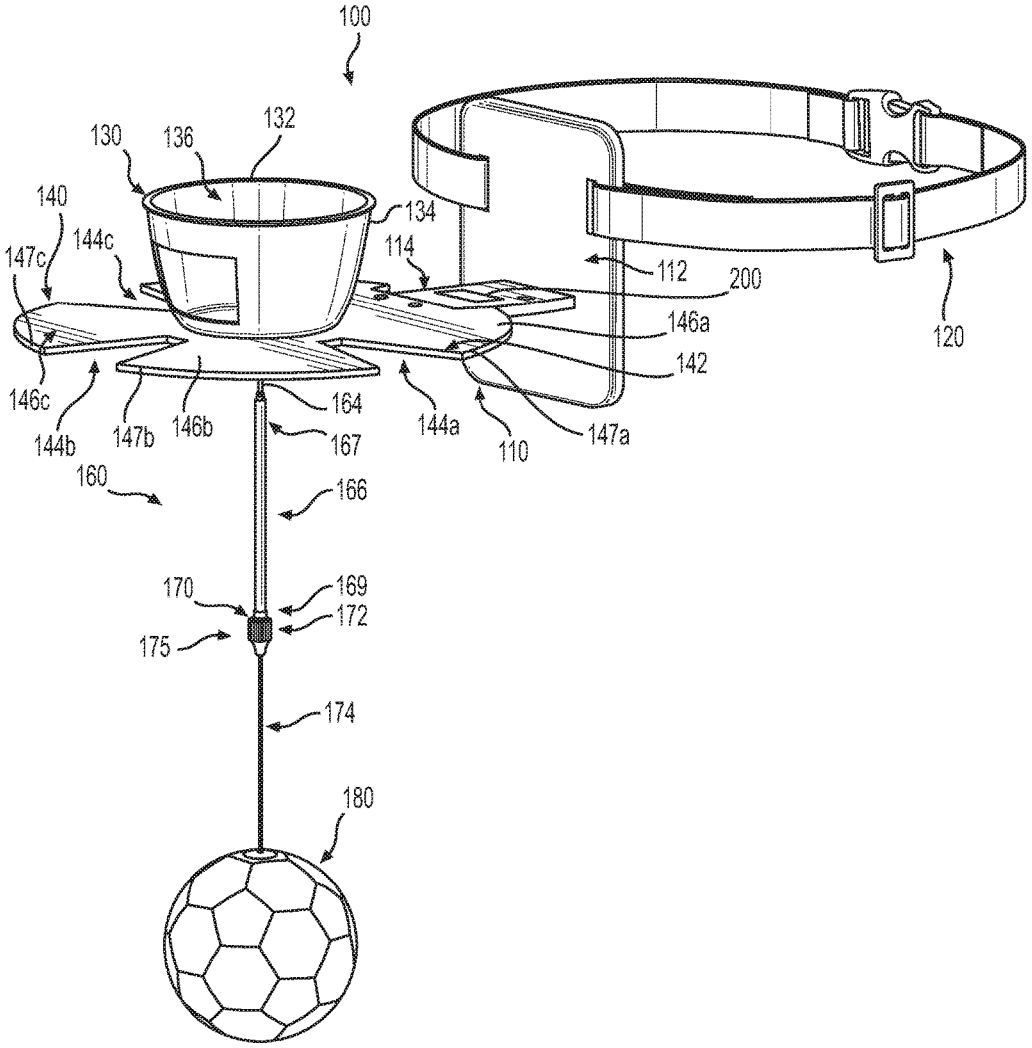
FIG. 1 is a perspective view of a game system encompassing aspects of the present disclosure.

The present disclosure is directed to a game system that can be mounted on the abdominal area of a player's torso and allow the player to play a hands-free game in which the player uses legs and feet to kick the game system ball into the goal. The game systems of the present disclosure can be configured for the player to use gross motor skills and move major muscle groups, such as those of the torso and legs, during game play. In some embodiments, the game system can include a plurality of balls of varying size, resiliency, and/or appearance to allow players of various ages and ability to play effectively.

As used herein, the singular forms of "a," "an," and "the" encompasses the plural form thereof unless otherwise indicated. As used herein, the phrase "at least one" includes all numbers of one and greater. As used herein, the term "and/or" refers to one or all of the listed elements or a combination of any two or more of the listed elements. As used herein, the term "below" encompasses alignments in which one element of the game system is directly above in the same vertical plane another element of the game system and also in which one element of the game system is positioned at a lower elevation but not in the same vertical plane as another element.

FIGS. 1-10 show a game system 100 encompassing aspects of the present disclosure. The game system 100 includes a base 110 that includes a baseboard 112 and a neck 114 that extends outward from the baseboard 112. The baseboard 112 of the base 110 is configured to be positioned against the abdominal area of the player's torso 501. A strap 120 is connected to the baseboard 112 and can be wrapped around and secured to the player's torso 501 so that the game system 100 is thereby mounted on the player's torso 501 during game play with the goal 130 aligned above the blocker plate 142. The neck 114 of the base 110 can extend outward from the baseboard 112 at about a 90° angle.

The neck 112 supports a goal 130, a blocker plate 142 aligned below the goal 130, and a ball 180 suspended from a tether 160 below the goal 130. The goal 130 includes a goal rim 132 that defines a goal opening 136. The goal 130 includes a basket 134 on which the goal rim 132 is disposed. The goal opening 136 defined by the goal rim 132 is sized to receive the ball 180 of the game system 100 and the basket 134 can hold at least a portion of the ball 180 once the ball 180 enters the goal opening 132.

The blocker plate 142 is mounted on the neck 114 of the base 110 and disposed below the goal rim 132 of the goal 130. The blocker plate 142 comprises a plurality of blocker lobes 140 that comprises blocker lobes 146*a*, 146*b*, 146*c*, and 146*d* that project radially outward from an axis 189 extending through the blocker plate 142 and the goal 130. The blocker lobes 146*a*, 146*b*, 146*c*, and 146*d* are axially aligned with the goal opening 136 of the goal 130. Each blocker lobe 146*a*, 146*b*, 146*c*, and 146*d* can be aligned parallel to the goal rim 132. Each blocker lobe 146*a*, 146*b*, 146*c*, and 146*d* of the plurality of blocker lobes 140 comprises an arcuate outer edge 147*a*, 147*b*, 147*c*, and 147*d*, respectively. In one aspect, each of the arcuate outer edges 147*a*, 147*b*, 147*c*, and 147*d* of the blocker lobes 146*a*, 146*b*, 146*c*, and 146*d* can be circumferentially aligned along a circle through the center of which extends the axis 189, which also extends through the center of a circle defining the goal rim 132. In another aspect, each of the arcuate outer edges 147*a*, 147*b*, 147*c*, and 147*d* of the blocker lobes 146*a*, 146*b*, 146*c*, and 146*d* can be aligned on an arc extending from the axis 189.

Figure 2:
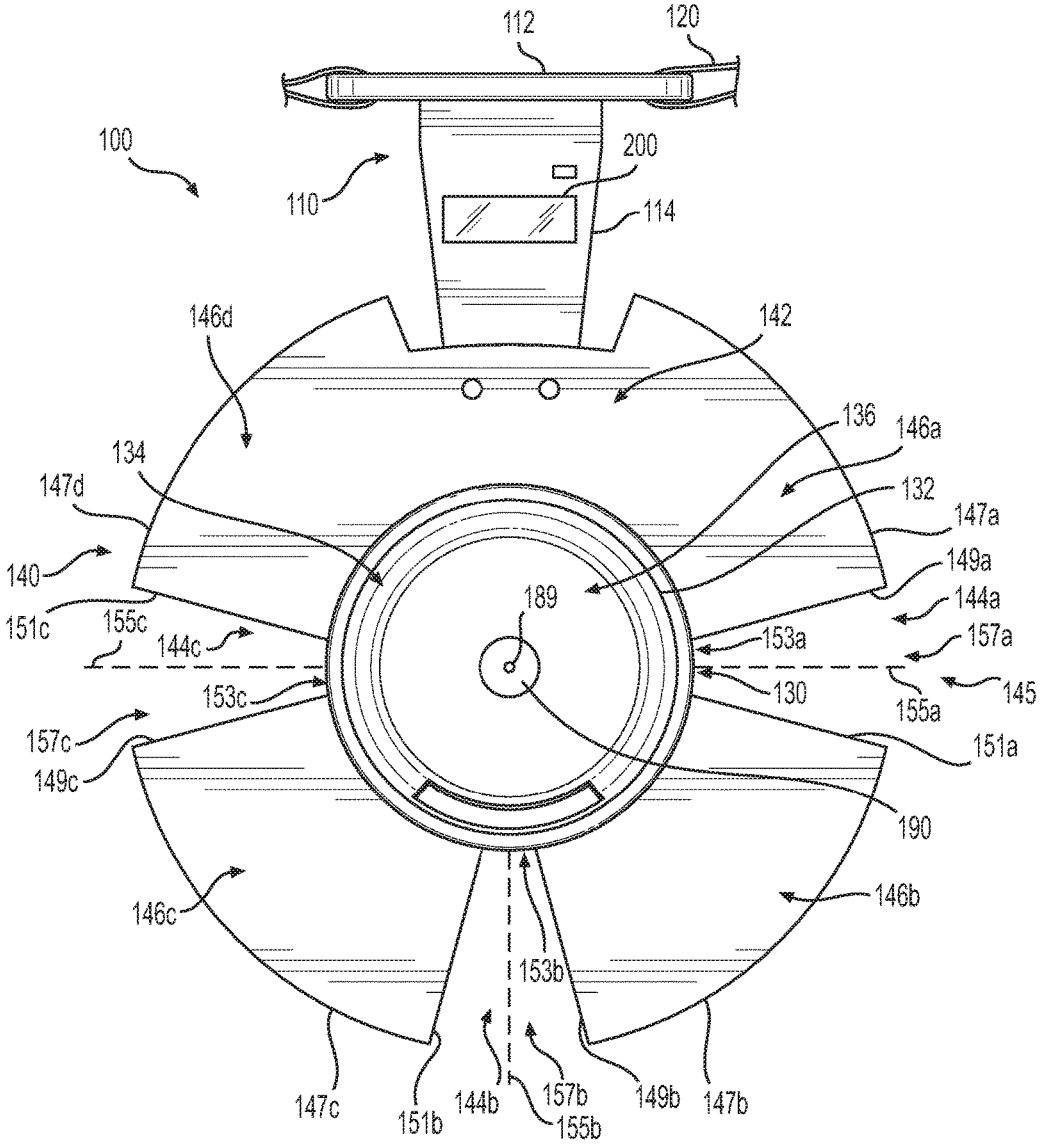
FIG. 2 is a top view of the game system shown in FIG. 1.
Figure 3:
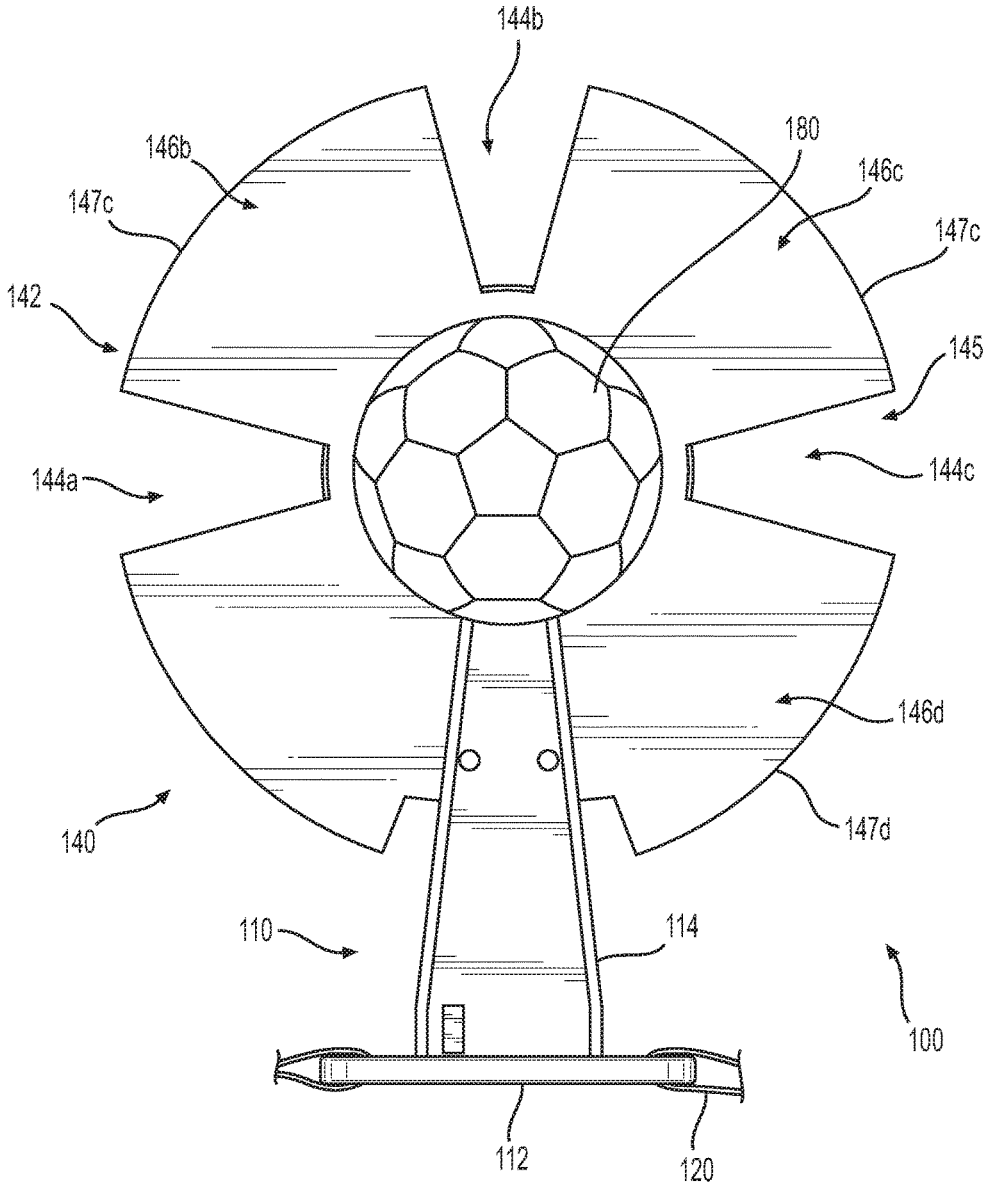
FIG. 3 is a bottom view of the game system shown in FIG. 1.

At least a portion of each of the blocker lobes 146*a*, 146*b*, 146*c*, and 146*d* of the plurality of blocker lobes 140 is separated from the adjacent blocker lobes. Adjacent blocker lobes 146*a*, 146*b*, 146*c*, and 146*d* cooperate to define channels 144*a*, 144*b*, and 144*c*. Each channel 144*a*, 144*b*, and 144*c* of the plurality of channels 145 comprises a first side 149*a*, 149*b*, and 149*c* and an opposing second side 151*a*, 151*b*, and 151*c*, respectively. The first sides 149*a*, 149*b*, and 149*c* and the second sides 151*a*, 151*b*, and 151*c* also form the respective sides of the blocker lobes 146*a*, 146*b*, 146*c*, and 146*d*. As shown in FIG. 2, the plurality of channels 145 can comprises three channels 144*a*, 144*b*, and 144*c*. The first and second sides 149*a*, 149*b*, 149*c*, 151*a*, 151*b*, and 151*c* of the channels 144*a*, 144*b*, and 144*c* can be arranged in non-parallel alignment to each other, whereby each of the channels 144*a*, 144*b*, and 144*c* is wider at their respective distal channel ends 157*a*, 157*b*, ands 157*c*, adjacent the arcuate outer edges of the adjacent blocker lobes, than at their proximal channel ends 153*a*, 153*b*, and 153*c*. The distal channel ends 157*a*, 157*b*, and 157*c* of the channels 144*a*, 144*b*, and 144*c* are disposed farther from the goal 130 than the proximal channel ends 153*a*, 153*b*, and 153*c*. The midline 155*a*, 155*b*, and 155*c* of each channel 144*a*, 144*b*, and 144*c* can be radially aligned with the axis 189, while each of the first side 149*a*, 149*b*, and 149*c* and the second sides 151*a*, 151*b*, and 151*c* of adjacent blocker lobes 146*a*, 146*b*, 146*c*, and 146*d* can be aligned either in a radial or a non-radial alignment with the axis 189.

Figure 4:
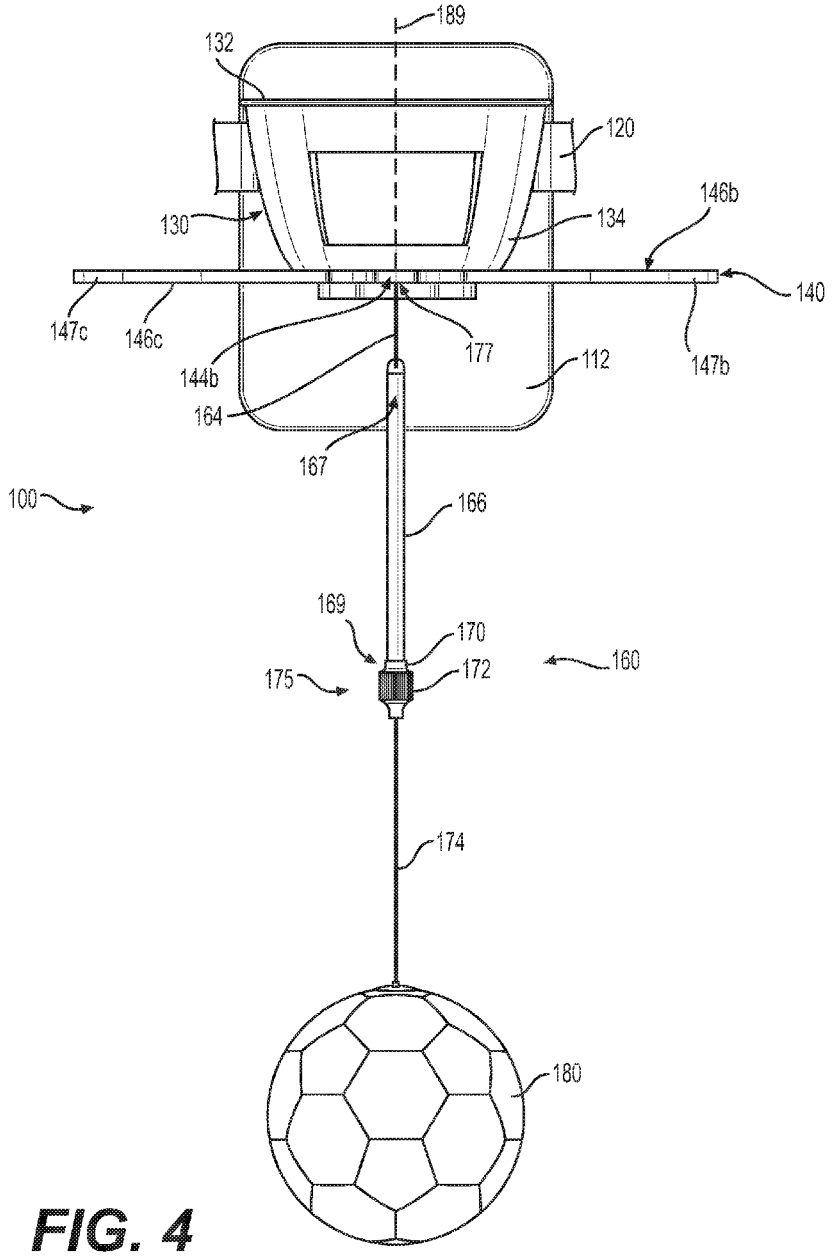
FIG. 4 is a front view of the game system shown in FIG. 1.

The tether 160 comprises a first flexible tether member 164 connected to and supporting an elongated rigid tether member 166, which in turn is connected to and supporting a second flexible tether member 174, which is connected to and supports the ball 180. The tether 160 is connected to the remainder of the game system 100 at an anchor site 177. The anchor site 177 can be at the blocker plate 142, as shown in FIG. 4, or at the neck 114 of the base 110, not shown. The first flexible tether member 164 is attached to the anchor site 177 at one end thereof and is connected at or adjacent the other end thereof to the elongated rigid tether member 166. The first flexible tether member 164 can comprise a flexible string, yarn, cord, wire, chain or other similarly flexible material that can bend, flex, and twist as the tether 160 moves during game play. As shown in FIG. 4, the first flexible tether member 164 comprises a flexible cord.

The elongated rigid tether member 166 comprises a proximal end 167 and an opposing distal end 169. The proximal end 167 of the elongated rigid tether member 166 is aligned proximal to first flexible tether member 164 and the anchor site 177 and the proximal end is aligned distal to first flexible tether member 164 and the anchor site 177. The elongated rigid tether member 166 is pivotally connected to the first flexible tether member 164, whereby the elongated rigid tether member 166 can move pivotally relative to the first flexible tether member 164. The pivotal connection of the elongated rigid tether member 166 to the first flexible tether member 164 allows the elongated rigid tether member flexible 164 to swing upward whereby the distal end 169 is moved above the elevation of the proximal end 164 of the elongated rigid tether member 166. The elongated rigid tether member 166 is made of a rigid thermoplastic or other suitable material that is both lightweight and rigid enough to maintain its shape.

Figure 7:
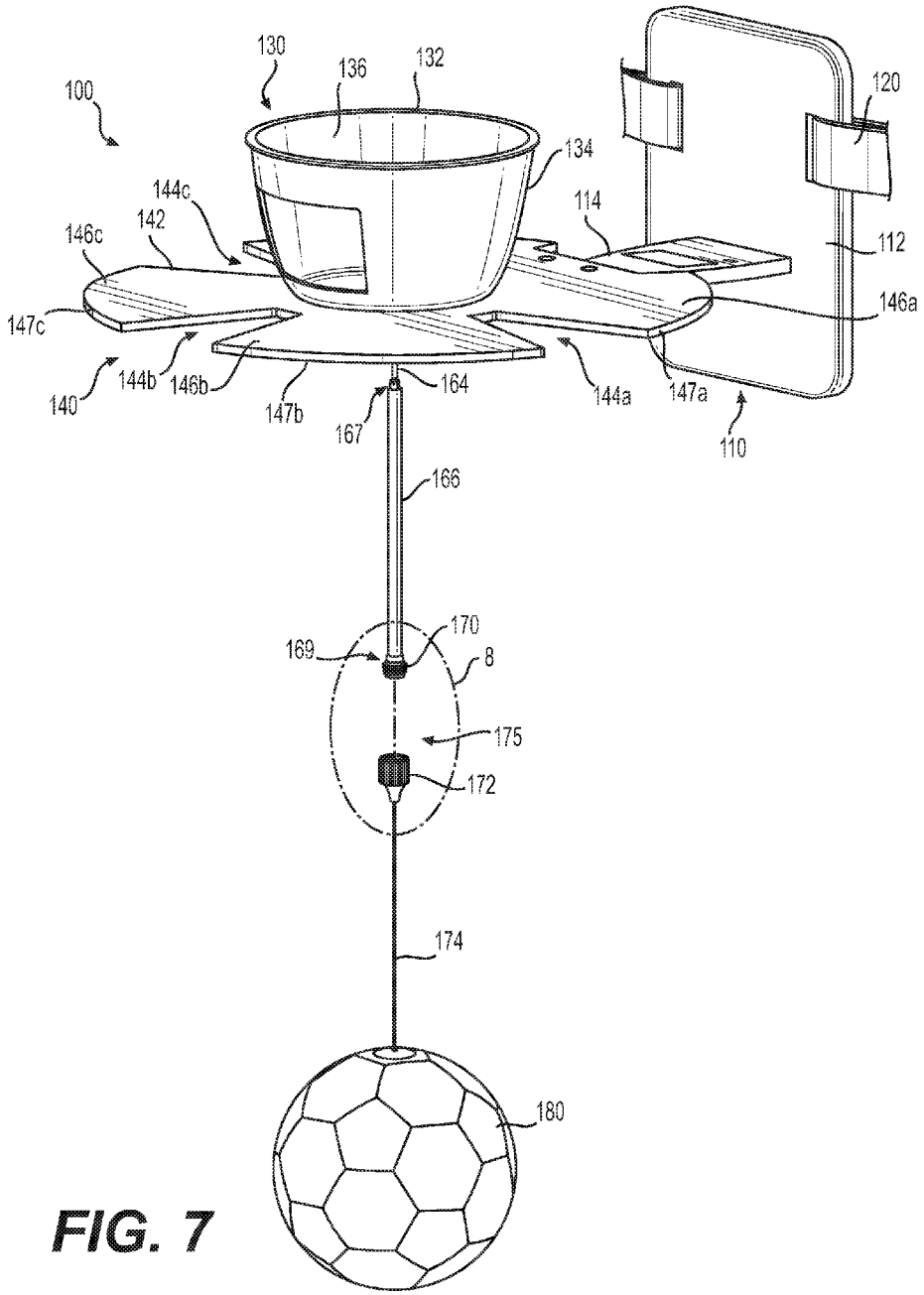
FIG. 7 is a perspective view of the game system shown in FIG. 1 with a portion of the fastener disposed on the tether shown in a partial exploded view.
Figure 8:
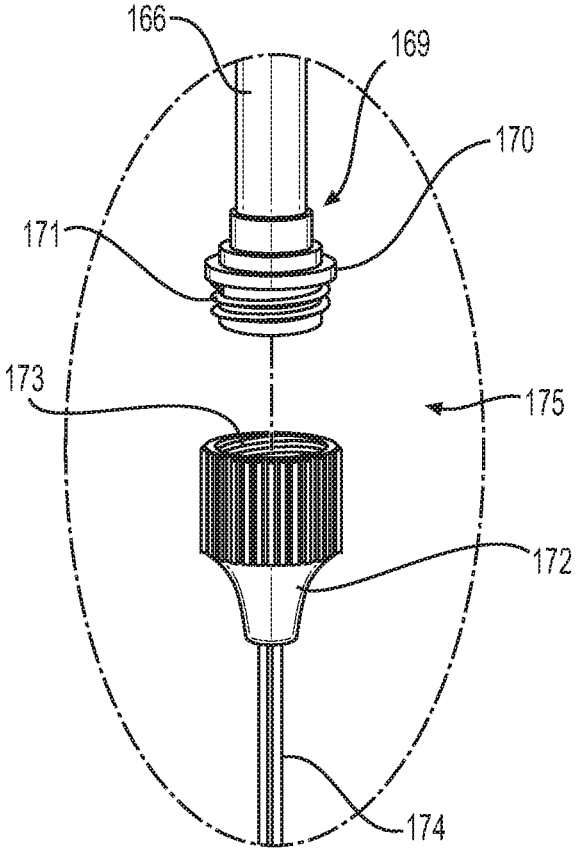
FIG. 8 is an expanded view of the partial exploded portion of FIG. 7 taken along line 8.

The second flexible tether member 174 is detachably connected to the distal end 169 of the elongated rigid tether member 166. The second flexible tether member 174 is connected to the elongated rigid tether member 166 by a fastener 175. As shown in FIGS. 7 and 8, the fastener 175 comprises a first fastener member 170 attached to the distal end 169 of the elongated rigid tether member 166 and a second fastener member 172 attached to the second flexible member 174. The first fastener member 170 is detachably connected to the second fastener member 172 by first thread 171 formed on the first fastener member 170. The first thread 171 can threadably engage a second thread 173 formed on the second fastener member 172. As shown in FIG. 8, the first fastener member 170 is a male portion with the first thread 171 formed on the outside thereof, and the second fastener member 172 is a female portion with the second thread 173 formed on the inside thereof. Like the first flexible tether member 164, the second flexible tether member 174 can comprise a flexible string, yarn, cord, wire, chain or other similarly flexible material that can bend, flex, and twist as the tether 160 moves during game play. The flexibility of the second flexible tether member 174 allows the ball 180 to move in any direction relative to the elongated rigid tether member 166. As shown in FIG. 8, the first flexible tether member 174 comprises a flexible cord.

Figure 9:
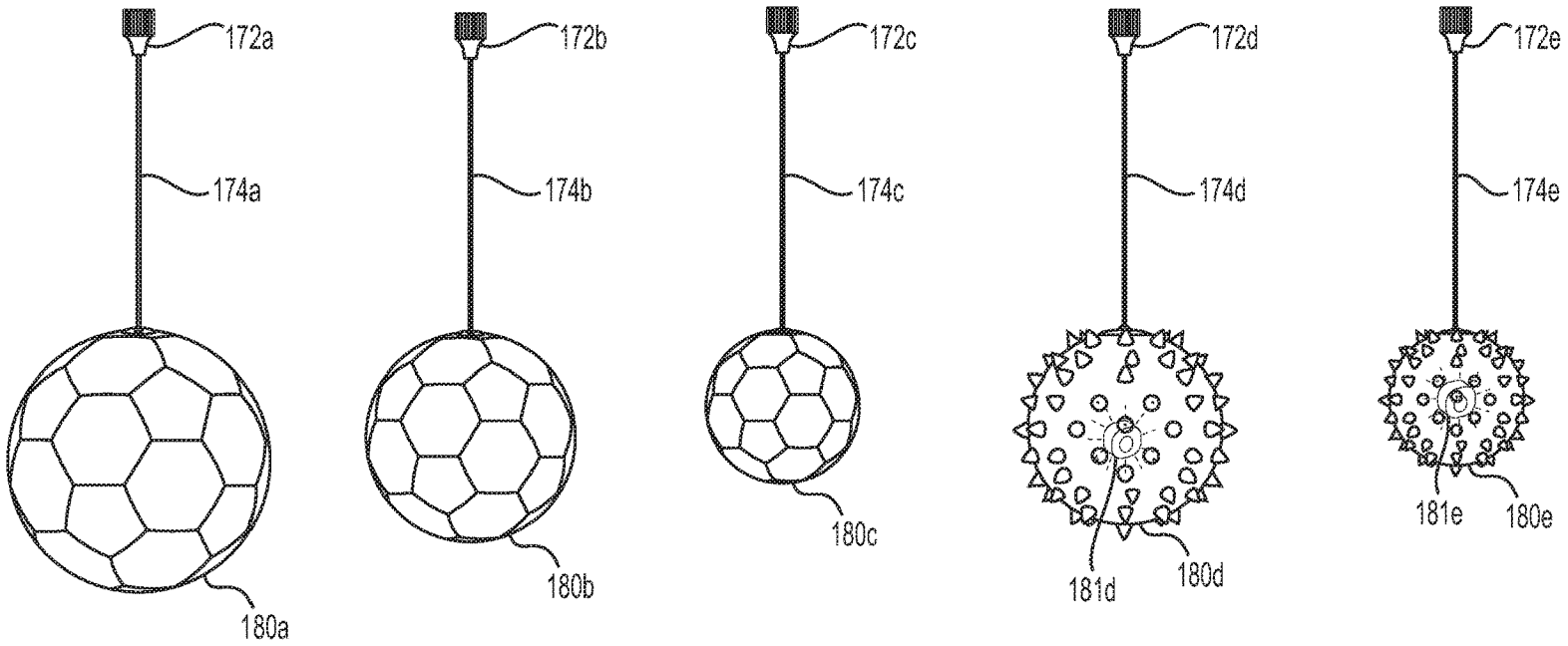
FIG. 9 is a side view of different ball and connector combinations that can be interchangeably incorporated into the game system shown in FIG. 1.

The ball 180 is suspended by the tether 160, which is long enough to allow the ball 180 to move freely below and swing above the blocker plate 142 and to swing into the goal 130, if the tether 160 is properly aligned with the blocker plate 142. The ball 180 is made of a resilient material, such as an elastomer or other suitable material that can be kicked by the player without injury. As shown in FIG. 9, the game system 100 of the present disclosure can comprise a plurality of interchangeable balls 180*a*, 180*b*, 180*c*, 180*d*, and 180*e* that can be detachably connected to the elongated rigid tether member 166 and used during game play. The balls 180*a*, 180*b*, 180*c*, 180*d*, and 180*e* vary in size, materials of construction, and/or weights so as to allow players to choose a ball that is the most appropriate for the player's size, age and skill level thereby increasing the enjoyment of the game system 100 for a variety of players. Each ball 180*a*, 180*b*, 180*c*, 180*d*, and 180*e* is attached to a separate second flexible tether member 174*a*, 174*b*, 174*c*, 174*d*, and 174*e*, respectively, that can be detachably connected to the elongated rigid tether member 160 by the threading of the attached second fastener member 172*a*, 172*b*, 172*c*, 172*d*, and 172*e*. The balls 180*a*, 180*b*, and 180*c* can comprise a soccer ball pattern outer layer comprising a plurality of octagonal patches formed of vinyl, leather, rubber, or other suitable soft and resilient material. The balls 180*d* and 180*e* can comprise a translucent material forming the outer layer of each ball. Each of the balls 180*d* and 180*e* can comprise a light 181*d* and 181*e*, respectively, disposed therein that can light when moved vigorously or when struck with a foot, knee, or other part of a player's leg. The lights 181*d* and 181*e* can shine through the translucent outer layers of the balls 180*d* and 180*e* thereby providing an appealing visual effect that can entertain players.

Figure 10:
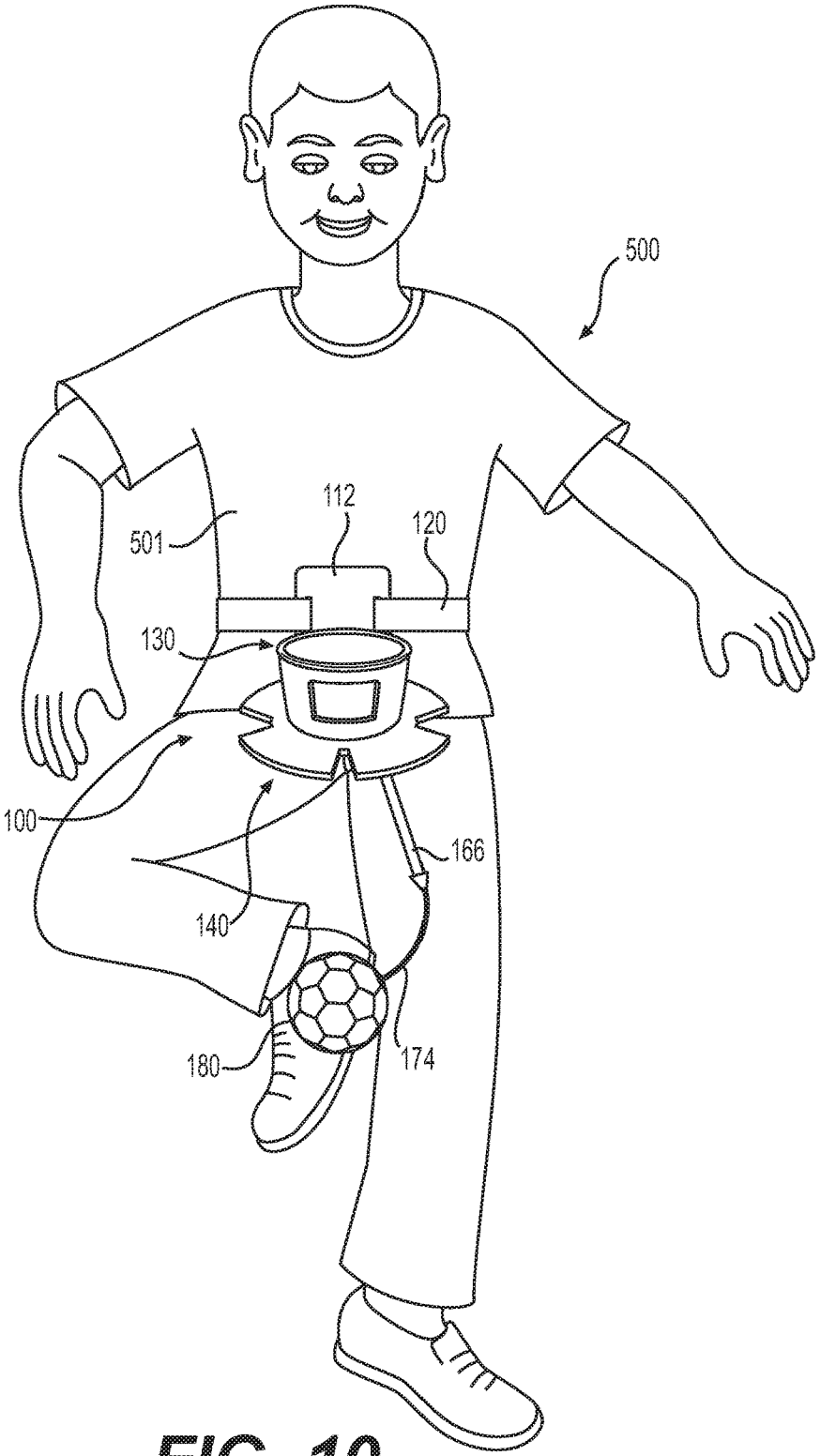
FIG. 10 is a perspective view of a player with the game system shown in FIG. 1 mounted on the player's torso.

As shown in FIG. 10, the game system 100 can be used to play a game by first wrapping the strap 120 around the waist of the player 500, thereby securing the game system 100 to the player's torso 501. The baseboard 112 of the base 110 is placed in a secure alignment against the abdominal section of the torso 501 of the player 500 so that the neck 114 of the base 120 extends outward therefrom from the player's abdominal area, thereby placing the goal 130 in front of the player 500. The alignment of the game system 100 on the player's torso 501 positions the blocker plate 142 below the goal 130 with the ball 180 suspended below the blocker plate 142 and the goal 130 by the tether 160.

Figure 6:
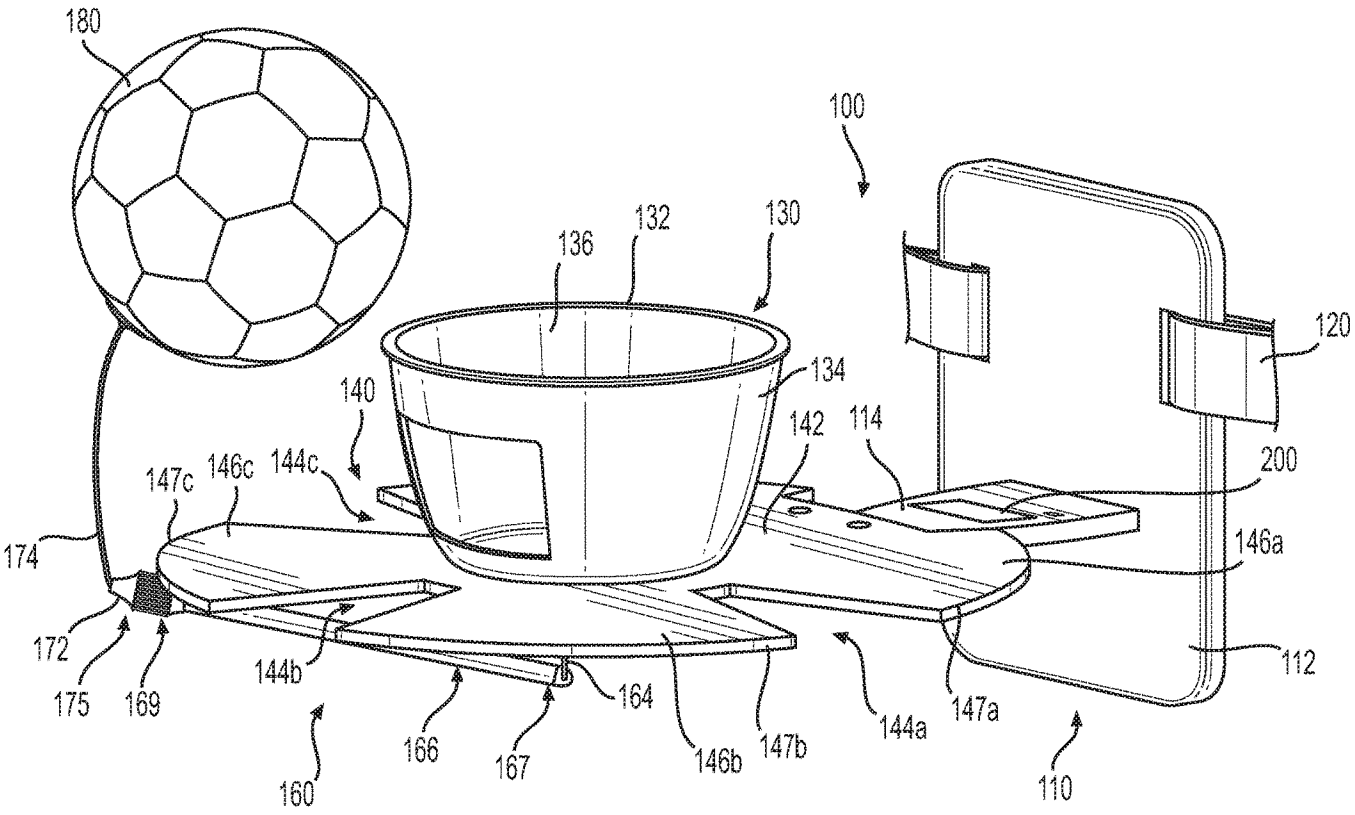
FIG. 6 is a perspective view of the game system shown in FIG. 1 with the ball blocked from entering the goal by one of the blocker plate and the elongated rigid tether member arrested by one of the blocker lobes.

To play a game, the player kicks or strikes the ball 180 with a foot, knee, or other part of either leg, thereby causing the ball 180 to swing and/or otherwise move upward. The upward movement of the ball 180 causes the tether 160, including the elongated rigid tether member 166 and the second flexible tether member 174, to swing upward. If the trajectory of the ball 180 causes the elongated rigid tether member 166 to swing upward into one of the blocker lobes 146*a*, 146*b*, 146*c*, or 146*d*, the blocker lobe 146*a*, 146*b*, 146*c*, or 146*d* that contacts the elongated rigid tether member 166 will arrest the upward movement of the elongated rigid tether member 166, thereby preventing the ball 180 from moving close enough to the goal rim 132 to allow the ball 180 to enter the goal opening 136. If the blocker plate 142 arrests the upward movement of the elongated rigid tether member 166, the ball 180 will tend to bounce and swing back downward below the blocker plate 142. FIG. 6 shows the position of the tether 160 when the elongated tether member 166 engages the blocker lobe 146*c*, which arrests the upward movement of the elongated rigid tether member 166, thereby preventing the distal end 169 of the elongated tether member 166 from moving upward above the blocker plate 142. The ball 180 cannot reach the goal rim 132 of the goal 130 since its upward movement is constrained by the tether 160.

Figure 5:
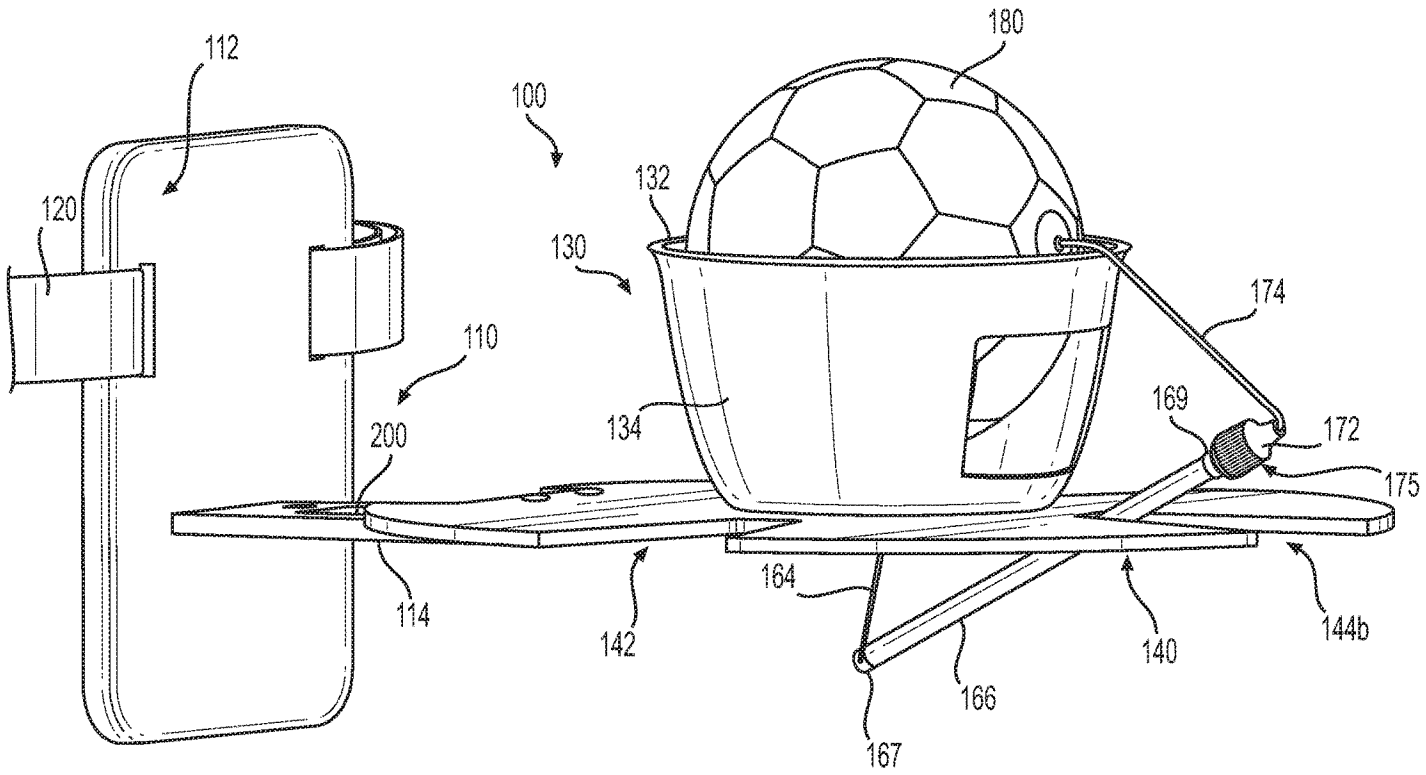
FIG. 5 is a perspective view of the game system shown in FIG. 1 with the ball in the goal and the elongated rigid tether member is disposed in one of the channels of the blocker plate.

The player 500 can try to kick the ball 180 again into the goal 130. If the trajectory of the ball 180 moves the elongated rigid tether member 160 into one of the channels 144*a*, 144*b*, or 144*c* formed in the blocker plate 142, then the distal end 169 of the elongated rigid tether member 166 can move upward above the blocker plate 142, thereby allowing the ball 180 to move upward high enough to allow the ball 180 to enter the goal 130. If the ball 180 does enter the goal 130 through the goal rim 132, a goal is scored. The positioning of the ball 180 in the basket 134 of the goal 130 will cause the ball 180 to contact and to activate the sensor 190 disposed at the base of the basket 134. The sensor 180 will activate the scoreboard 200 to register a goal. The scoreboard 200 can include a timer that allows for game play to be timed and monitored. The sensor 180 and the scoreboard 200 can be configured to operate mechanically and/or electronically using systems known in the art. FIG. 5 shows the alignment of the elongated tether member 166 with the channel 144*b*, whereby the distal end 169 is above the blocker plate 142, thereby allowing the ball 180 to move into the goal 130.

Multiple players can play games using the game systems 100 of the present disclosure. When more than one player wishes to compete in a head-to-head competition with other players, each player can use a game system 100 as described and play simultaneously with the other players. The scoring and/or timing functions of the scoreboard 200 can be used to monitor each player's progression and allotted playing time, thereby allowing the game system 100 to be used for entertainment in a variety of social settings.

The embodiments set forth herein are provided to illustrate the scope of the present disclosure, but are not provided to limit the scope thereof. The present disclosure contemplates alternative combinations and modifications of the features disclosed herein without departing from the scope thereof. Alternatives, variations and modifications of the embodiments described herein will be apparent to one of ordinary skill in the art and are encompassed by the present disclosure.

The invention claimed is:

1. A game system for playing a goal-scoring game using the player's feet or legs to kick a ball, the game system comprising:

a base, wherein the base comprises a baseboard and a neck extending from the baseboard, whereby the baseboard is configured to be aligned against a player's torso;

a strap connected to the base, whereby the strap is configured to engage a portion of the player's torso to align the baseboard of the base against the player's torso;

a goal mounted on the neck of the base, wherein the goal comprises a basket with a goal rim thereon, wherein the goal rim defines a goal opening;

a ball;

a tether suspended from an anchor site disposed below the goal, wherein the anchor site is on an axis extending through a center of the goal opening, wherein the tether comprises an elongated rigid tether member and a flexible tether member, wherein the elongated rigid tether member comprises a proximal end and a distal end, wherein the elongated rigid tether member is pivotally mounted below the goal with the proximal end of the elongated rigid tether member aligned proximal to the anchor site and the distal end of the elongated rigid tether member aligned distal to the anchor site, wherein the flexible tether member is connected to the distal end of the elongated rigid tether member, wherein the ball is connected to the flexible tether member, and wherein the ball is configured to be kicked by the player; and, a blocker plate mounted on the neck of the base and disposed below the goal, wherein the blocker plate comprises a plurality of blocker lobes and a plurality of channels, wherein each channel of the plurality of channels is disposed between two blocker lobes of the plurality of blocker lobes, wherein each blocker lobe of the plurality of blocker lobes is aligned to arrest upward movement of the elongated rigid tether member and to block the distal end of the elongated rigid tether member from moving above the blocker plate, wherein each channel of the plurality of channels is aligned to allow movement of the distal end of the elongated rigid tether member above the blocker plate, wherein each channel of the plurality of channels comprises a first side, a second side opposing the first side, a distal channel end aligned distal to the goal, and a proximal channel end aligned proximal to the goal, wherein the distal channel end is wider than the proximal channel end, and wherein the first side of each channel of the plurality of channels is aligned nonparallel to the second side of each channel.

2. The game system of claim 1, wherein each channel of the plurality of channels comprises a midline, and wherein the midline of each channel of the plurality of channels is radially aligned with the axis.

3. The game system of claim 2, wherein each blocker lobe of the plurality of blocker lobes comprises an arcuate outer edge.

4. The game system of claim 1, wherein the tether further comprises a fastener, and wherein the flexible tether member is detachably connected to the elongated rigid tether member by the fastener.

5. The game system of claim 4, wherein the fastener comprises a first fastener component mounted on the elongated rigid tether member and a second fastener component mounted on the flexible tether member, and wherein the first fastener component and the second fastener component cooperate to detachably connect the elongated rigid tether member to the flexible tether member.

6. A game system for playing a goal scoring game using the player's feet or legs to kick a ball, the game system comprising:

a base, wherein the base comprises a baseboard and a neck extending from the baseboard, whereby the baseboard is configured to be aligned against a player's torso;

a strap connected to the base, whereby the strap is configured to engage a portion of the player's torso to align the baseboard of the base against a player's torso;

a goal mounted on the neck of the base, wherein the goal comprises a goal rim, wherein the goal rim defines a goal opening;

a ball;

a tether suspended from an anchor site disposed below the goal, wherein the anchor site is on an axis extending through a center of the goal opening, wherein the tether comprises a first flexible member connected to a proximal end of an elongated rigid tether member and a second flexible tether member connected to a distal end of the elongated rigid tether member, and a fastener detachably connecting the elongated rigid tether member to the second flexible tether member, wherein the fastener comprises a first fastener component and a second fastener component, wherein the first fastener component is connected to the distal end of the elongated rigid tether member and the second fastener component is connected to the second flexible tether member, wherein the elongated rigid tether member is pivotally mounted below the goal rim with the proximal end of the elongated rigid tether member aligned proximal to the goal and the distal end of the elongated rigid tether member aligned distal to goal, wherein the ball is connected to the second flexible tether member, and wherein the ball is configured to be kicked by the player; and, a blocker plate mounted on the neck of the base and disposed below the goal rim, wherein the blocker plate comprises a plurality of blocker lobes and a plurality of channels, wherein each channel of the plurality of channels is disposed between two blocker lobes of the plurality of blocker lobes, wherein each blocker lobe of the plurality of blocker lobes is aligned to arrest upward movement of the elongated rigid tether member and to block the distal end of the elongated rigid tether member from moving above the blocker plate, and wherein each channel of the plurality of channels is aligned to allow movement of the distal end of the elongated rigid tether member above the blocker plate.

7. The game system of claim 6, wherein the first fastener component comprises a first thread and the second fastener member comprises a second thread, and wherein the first thread and the second thread cooperate to detachably connect the second flexible tether member to the elongated rigid tether member.

8. A game system for playing a goal scoring game using the player's feet or legs to kick a ball, the game system comprising:

a base, wherein the base comprises a baseboard and a neck extending from the baseboard, whereby the baseboard is configured to be aligned against a player's torso;

a strap connected to the base, whereby the strap is configured to engage a portion of the player's torso to align the baseboard of the base against a player's torso;

a goal mounted on the neck of the base, wherein the goal comprises a goal rim, wherein the goal rim defines a goal opening;

a ball;

a tether suspended below the goal rim, wherein the tether comprises a first flexible member connected to a proximal end of an elongated rigid tether member and a second flexible tether member connected to a distal end of the elongated rigid tether member, and a fastener detachably connecting the elongated rigid tether member to the second flexible tether member, wherein the fastener comprises a first fastener component and a second fastener component, wherein the first fastener component is connected to the distal end of the elongated rigid tether member and the second fastener component is connected to the second flexible tether member, wherein the elongated rigid tether member is pivotally mounted below the goal rim with the proximal end of the elongated rigid tether member aligned proximal to the goal and the distal end of the elongated rigid tether member aligned distal to goal, wherein the ball is connected to the second flexible tether member, and wherein the ball is configured to be kicked by the player; and, a blocker plate mounted on the neck of the base and disposed below the goal rim, wherein the blocker plate comprises a plurality of blocker lobes and a plurality of channels, wherein each channel of the plurality of channels is disposed between two blocker lobes of the plurality of blocker lobes, wherein each blocker lobe of the plurality of blocker lobes is aligned to arrest upward movement of the elongated rigid tether member and to block the distal end of the elongated rigid tether member from moving above the blocker plate, and wherein each channel of the plurality of channels is aligned to allow movement of the distal end of the elongated rigid tether member above the blocker plate, and wherein the goal comprises a basket disposed above the blocker plate.

9. The game system of claim 6, wherein each channel of the plurality of channels comprises a midline, and wherein the midline of each channel of the plurality of channels is radially aligned with the axis.

10. The game system of claim 6, wherein each blocker lobe of the plurality of blocker lobes comprises an arcuate outer edge.

11. The game system of claim 6, wherein each channel of the plurality of channels comprises a first side, a second side opposing the first side, a distal channel end aligned distal to the goal, and a proximal channel end aligned proximal to the goal, wherein the distal channel end is wider than the proximal channel end, and wherein the first side of each channel of the plurality of channels is aligned nonparallel to the second side of each channel.

* * * * *